US010562548B2

(12) United States Patent
Saxton

(10) Patent No.: US 10,562,548 B2
(45) Date of Patent: Feb. 18, 2020

(54) ATTACHMENT OF ARTICULATED CONNECTORS IN MULTI-UNIT FREIGHT CARS

(71) Applicant: Gunderson LLC, Portland, OR (US)

(72) Inventor: Gregory J Saxton, Portland, OR (US)

(73) Assignee: Gunderson LLC, Portland, OR (US)

( * ) Notice: Subject to any disclaimer, the term of this patent is extended or adjusted under 35 U.S.C. 154(b) by 316 days.

(21) Appl. No.: 15/678,979

(22) Filed: Aug. 16, 2017

(65) Prior Publication Data

US 2019/0054934 A1 Feb. 21, 2019

(51) Int. Cl.

| | |
|---|---|
| ***B61G 5/02*** | (2006.01) |
| ***B61G 9/22*** | (2006.01) |
| ***B61G 1/28*** | (2006.01) |
| ***B61G 9/24*** | (2006.01) |

(52) U.S. Cl.

CPC ..... *B61G 5/02* (2013.01); *B61G 1/28* (2013.01); *B61G 1/283* (2013.01); *B61G 9/22* (2013.01); *B61G 9/24* (2013.01)

(58) Field of Classification Search

CPC . B61G 1/283; B61G 5/02; B61G 9/22; B61G 9/24; B61G 7/10; B61F 5/16; B61F 1/02; B61F 1/10; B61D 3/10

See application file for complete search history.

(56) References Cited

U.S. PATENT DOCUMENTS

| | | | | |
|---|---|---|---|---|
| 2,073,013 | A | 3/1937 | Jabelman | |
| 3,399,631 | A | 9/1968 | Weber | |
| 4,315,465 | A | 2/1982 | Cordani et al. | |
| 4,751,882 | A | 6/1988 | Wheatley et al. | |
| 5,207,161 | A | 5/1993 | Pileggi et al. | |
| 6,167,813 | B1 * | 1/2001 | Kaufhold ..... | B61G 5/02 105/3 |
| 6,510,800 | B1 | 1/2003 | Zaerr et al. | |
| 6,546,878 | B1 | 4/2003 | Smith et al. | |

* cited by examiner

*Primary Examiner* — Mark T Le

(74) *Attorney, Agent, or Firm* — Chernoff, Vilhauer, McClung & Stenzel, LLP

(57) ABSTRACT

Articulated connectors are attached to and extend from center sills of adjacent car units of a multi-unit railroad freight car, connecting the car units to each other and to a shared truck. The center sill of each of the car units includes a top member that is of increased thickness at the outer end of the center sill. A weld extending along a shoulder that extends around the main body of s portion of the articulated connector attaches the articulated connector portion to the outer end of the center sill with ample strength to carry draft and buff train loads as well as the weight of the car unit and its lading, without the need for weld joints inside the center sill.

15 Claims, 6 Drawing Sheets

ATTACHMENT OF ARTICULATED CONNECTORS IN MULTI-UNIT FREIGHT CARS

BACKGROUND OF THE INVENTION

The present application relates to multi-unit railroad freight cars, and in particular to the attachment of inter-unit articulated connectors to center sills of car units.

Multi-unit railroad freight cars, such as well cars for transporting stacked intermodal containers, utilize articulated connectors in the form of male and female castings that mate with one another to interconnect adjacent car units. The articulated connectors are connected to the car units by being welded to center sills that in some car units are tubular stub center sills welded to the undersides of body bolsters.

Not only do the articulated connectors carry the weight of a car unit and its lading to the top of a shared wheeled truck between a pair of adjacent car units, but they also have to carry lateral forces resulting from when the car negotiates a curve in a track and the draft and buff forces between cars and car units cumulatively resulting from moving the car along with others in a train.

After lengthy use, for example 1.5 million miles, the articulated connectors of a multi-unit railroad freight car need to be replaced. In the past this has been difficult, because some of the welds attaching an articulated connector to a center sill of a car unit are located within the center sill. This was thought necessary in the past in order to have enough welded metal to transmit the draft and buff train forces resulting from operating such multi-unit cars in trains that may weigh as much as 40 million pounds. Those forces must be carried from each articulating connector into each car unit through the center sill to which the connector is attached.

Each articulated connector unit includes a respective male or female coupling portion designed to extend from a center sill toward the shared truck and the adjacent car unit. An outer portion of each articulated connector unit abuts against the extreme end of the center sill to which it is attached, and another portion of the articulated connector extends for a distance inside a box beam structure of the center sill.

While welds at the extreme end of a center sill have always been used to attach an articulated connector, it was previously also considered necessary to have additional welds. In the past, additional welding has attached the portion of the articulated connector extending inside the center sill to the interior of the center sill. This was thought necessary to ensure that the connection of the articulated connector to the center sill is capable of carrying the magnitude of forces that may be experienced when such a multi-unit freight car is operated as part of a long, fully-loaded train.

Consideration was given to the use of slot welds, but slot welds have not proven practical, and so welds inside the box structure of a center sill have been used instead.

Because of the welds located within the center sill it has been necessary to cut into the center sill to detach a worn articulated connector so that a new articulated connector can be installed. When another connector is installed similar welds have had to be used and openings made in the center sill have had to be closed. These procedures have required an undesirable amount of labor. It is therefore desired to attach an articulating connector to a stub center sill in a manner that provides sufficient strength without the requirement for internal welds within a center sill.

SUMMARY OF THE INVENTION

As embodied in the invention disclosed hereinbelow in greater detail, an articulated connector is attached to a center sill of a car unit of a multi-unit railroad freight car in such a way as to be capable safely of carrying the forces encountered in operation of such a car unit in a train without welds located inside a center sill of such a car unit.

In accordance with an embodiment of the invention a center sill in which an articulated connector is mounted has a top member with at least an end portion of substantial thickness, extending to the extreme end of the center sill and interconnected with the articulated connector through a weld joint involving the entire thickness of the top member. A portion of the articulated connector extends within the center sill, but does not need to be welded to the interior of the center sill.

In one embodiment, the attachment of an articulated connector to a center sill of a railroad freight car unit includes a weld interconnecting an outer end of a generally tubular center sill with a surface of a shoulder that extends around the articulated connector and from which a portion of the articulated connector extends within the interior of the center sill.

In one embodiment at least the top of the articulated connector is welded to the center sill in a deep groove weld interconnecting the articulated connector to a top portion of the center sill that is of greater thickness than a bottom portion or side portions of the center sill.

The foregoing and other objectives and features of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
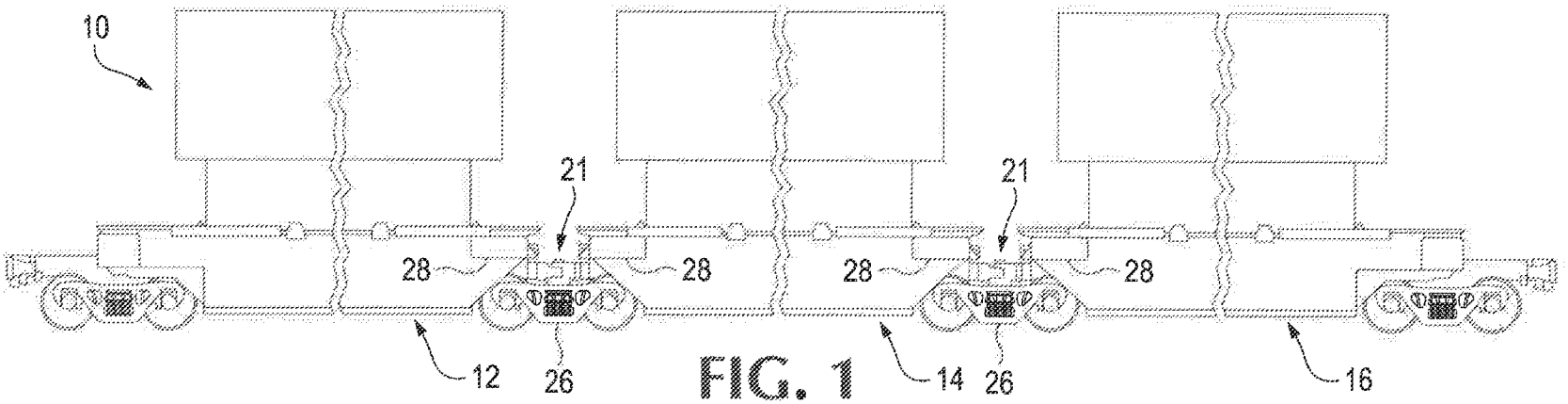
FIG. 1 is a side elevational view of a multi-unit railroad freight car.

Referring now to the drawings that form a part of the disclosure herein, in FIG. 1 a multi-unit railroad freight car 10 is depicted as having three car units 12, 14, and 16. Instead of a single intermediate car unit 14, there could be two or more similar intermediate car units.

Figure 2:
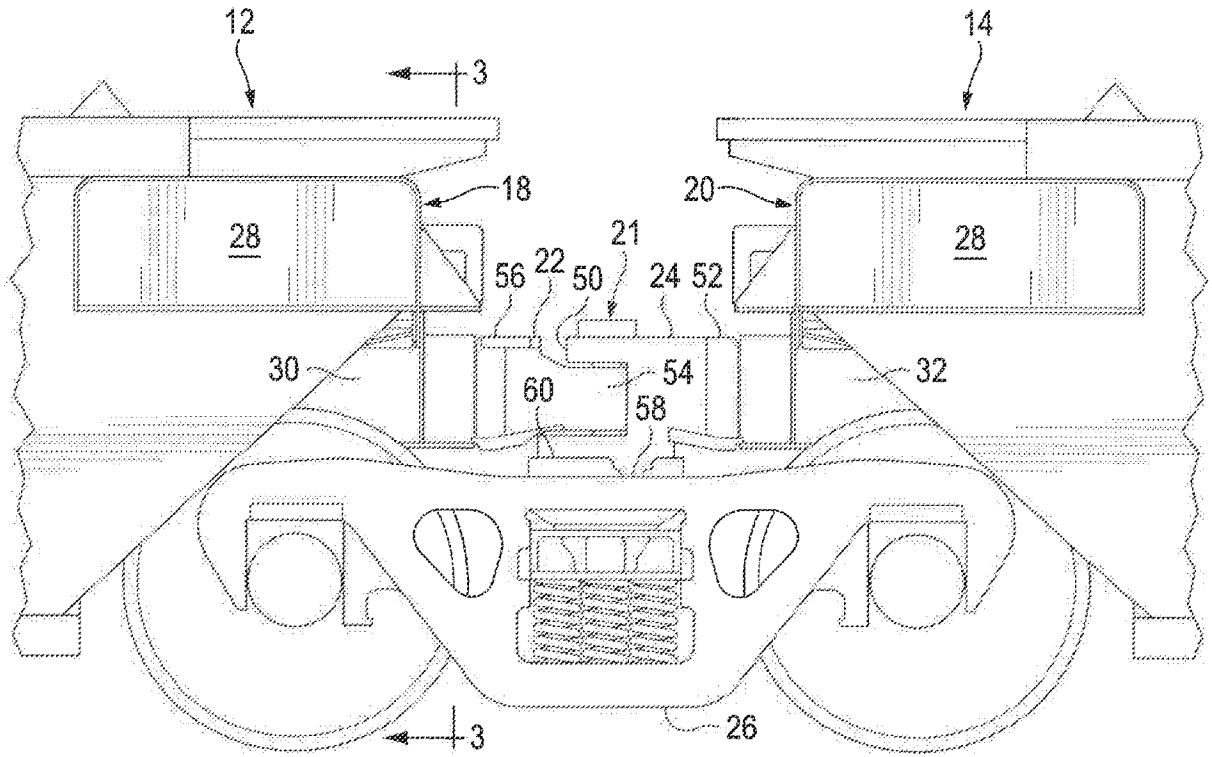
FIG. 2 is a side elevational view of an end portion of each of a pair of adjacent car units of the railroad freight car shown in FIG. 1, at an enlarged scale.

Both of the end car units 12 and 16 are connected with the adjacent intermediate car unit 14. As shown in FIG. 2, the adjacent ends 18 and 20 of the end car unit 12 and the intermediate car unit 14 are interconnected with each other by an articulated connector 21 including two mated male and female portions 22 and 24. Both of the mated portions 22 and 24 of the articulated connector 21 are supported by a single shared wheeled truck 26, which thus supports the adjacent ends 18 and 20 of the car units 12 and 14. Similarly, a shared wheeled truck 26 supports the adjacent ends of both of the car units 16 and 14, as shown in FIG. 1.

As shown in FIG. 1, each of the car units 12, 14, and 16 is a well car adapted to carry intermodal containers. It will be understood that other types of multi-unit freight cars may include car units that are similar to each other but that are designed for a different purpose than the multi-unit freight car 10.

As shown in FIG. 2, the end car unit 12 and the adjacent intermediate car unit 14 each include a respective car body. The end 18 of the body of the end car unit 12 and the adjacent end 20 of the body of the intermediate car unit 14 each include a respective body bolster 28 that extends transversely at the end of the car body and has a generally rectangular reinforced box beam structure. A stub center sill 30 is attached to the bottom of the body bolster 28 at the end 18 of the car unit 12, and a stub center sill 32 is similarly attached to the bottom of the body bolster 28 of the adjacent end 20 of the intermediate car unit 14. Each of the stub center sills 30 and 32 is mounted centrally of the width of the respective body bolster 28 and extends longitudinally of the respective car body, beyond the body bolster 28 and toward the adjacent car unit and the shared wheeled truck 26.

It will be understood that other multi-unit railroad freight cars with car units whose bodies are intended for different use than those of the multi-unit well car 10 may include full-length center sills or stub center sills of different design. So long as adjacent ends of the adjacent car units are supported by shared trucks 26, however, articulated connectors such as the articulated connector 21 may be used to support the adjacent ends of such car units on a shared truck 26. Such articulated connectors 21 are of suitably strong material such as cast or forged steel and may be attached to the center sills or stub center sills of those other multi-unit railroad freight cars in essentially the same way as described in this application for the attachment of articulated connector 21 to the stub center sills 30 and 32.

As shown in the drawings of this application, some of the usual components of car unit bodies, such as body side bearings, body side bearing arms, constant contact side bearings, and constant contact side bearing pedestals are not shown, so that they will not interfere with depiction of the articulated connectors 21 and their attachment to the car units 12, 14, and 16.

Each of the stub center sills 30 and 32 may be of welded plate construction and may include an elongate top member 36 that extends horizontally and may take the place of a central part of a bottom plate of the respective body bolster 28. The top member 36 is aligned with the length of the car unit 12 or 14 of which the body bolster 28 is a part.

Figure 3:
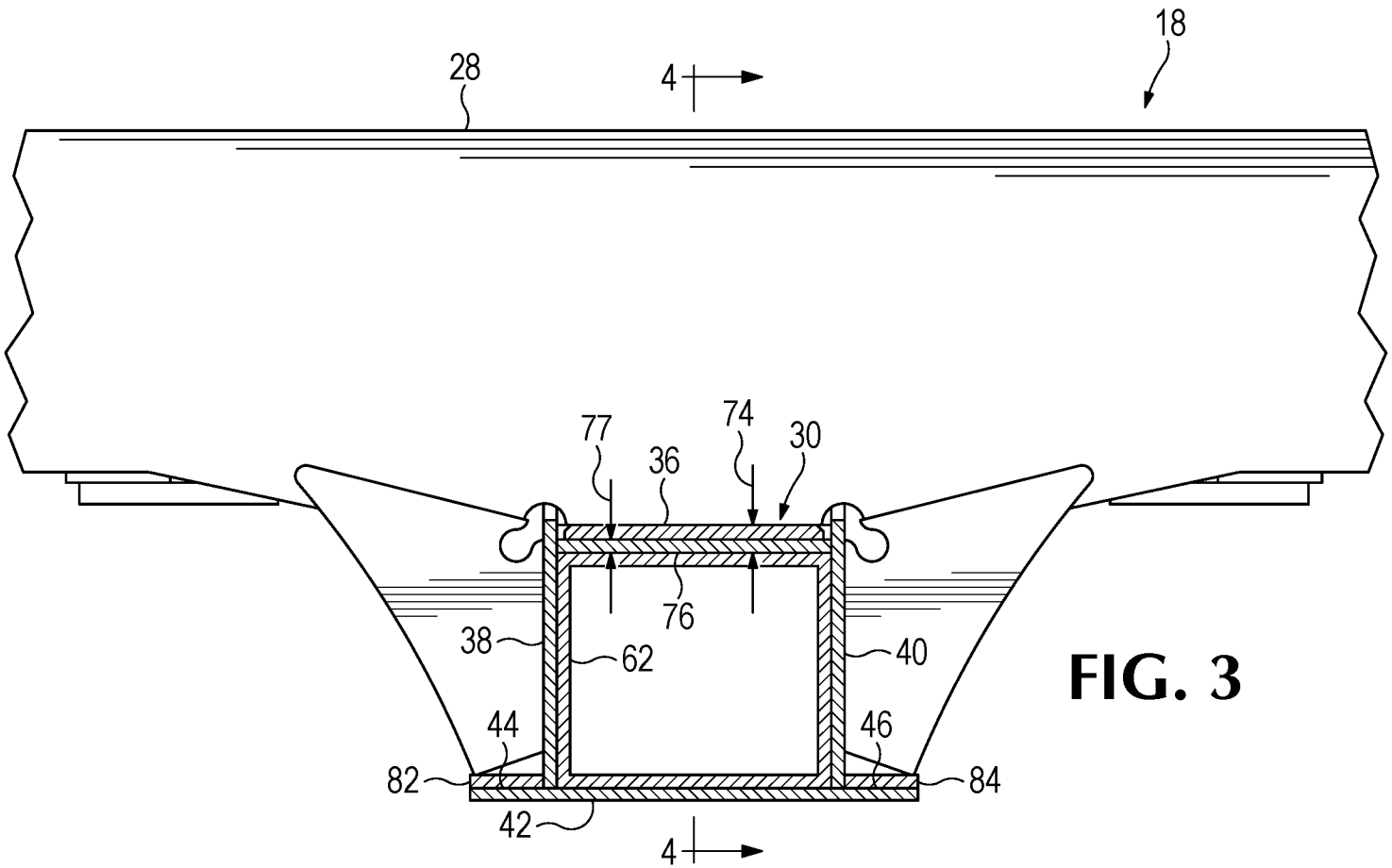
FIG. 3 is a sectional view, taken along line 3-3 in FIG. 2, showing a portion of a body bolster and a center sill of one of the car units of the multi-unit railroad freight car shown in FIG. 2, to which an articulated connector is attached.
Figure 4:
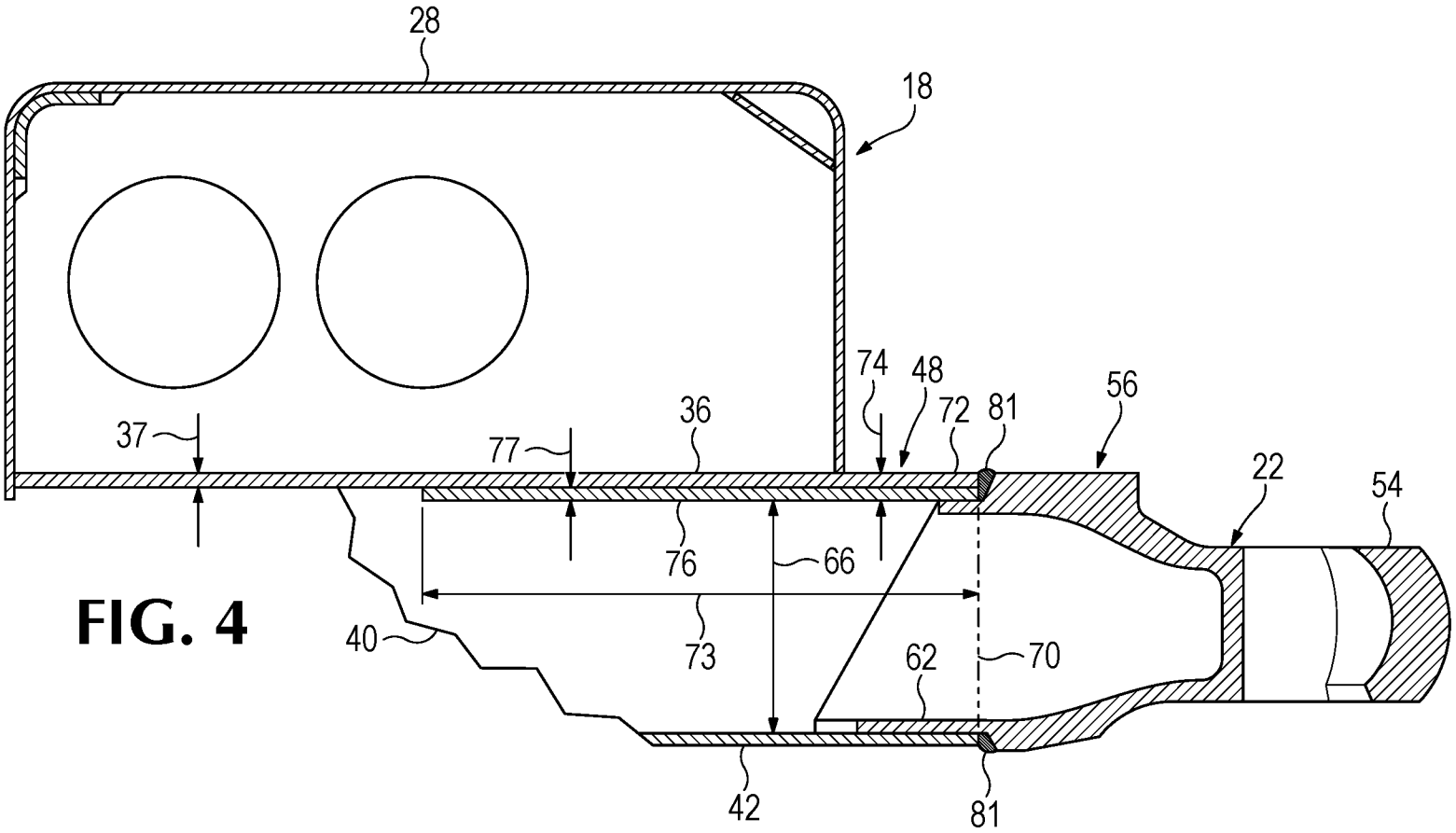
FIG. 4 is a sectional view taken along line 4-4 in FIG. 3, also showing an articulated connector attached to the center sill.
Figure 6:
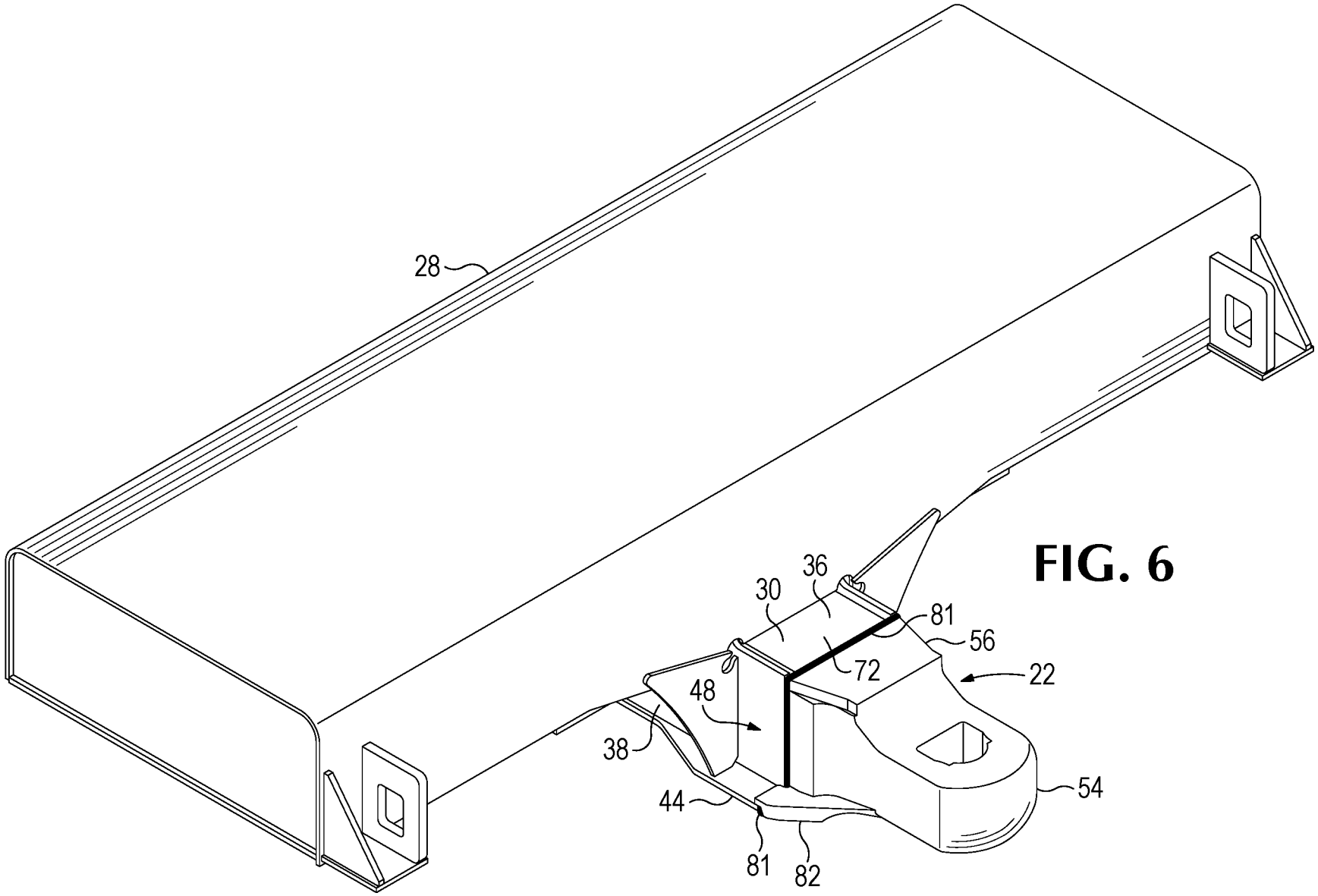
FIG. 6 is an isometric view of the body bolster, the center sill, and the articulated connector shown in FIGS. 3-5, taken from above and to one side.
Figure 7:
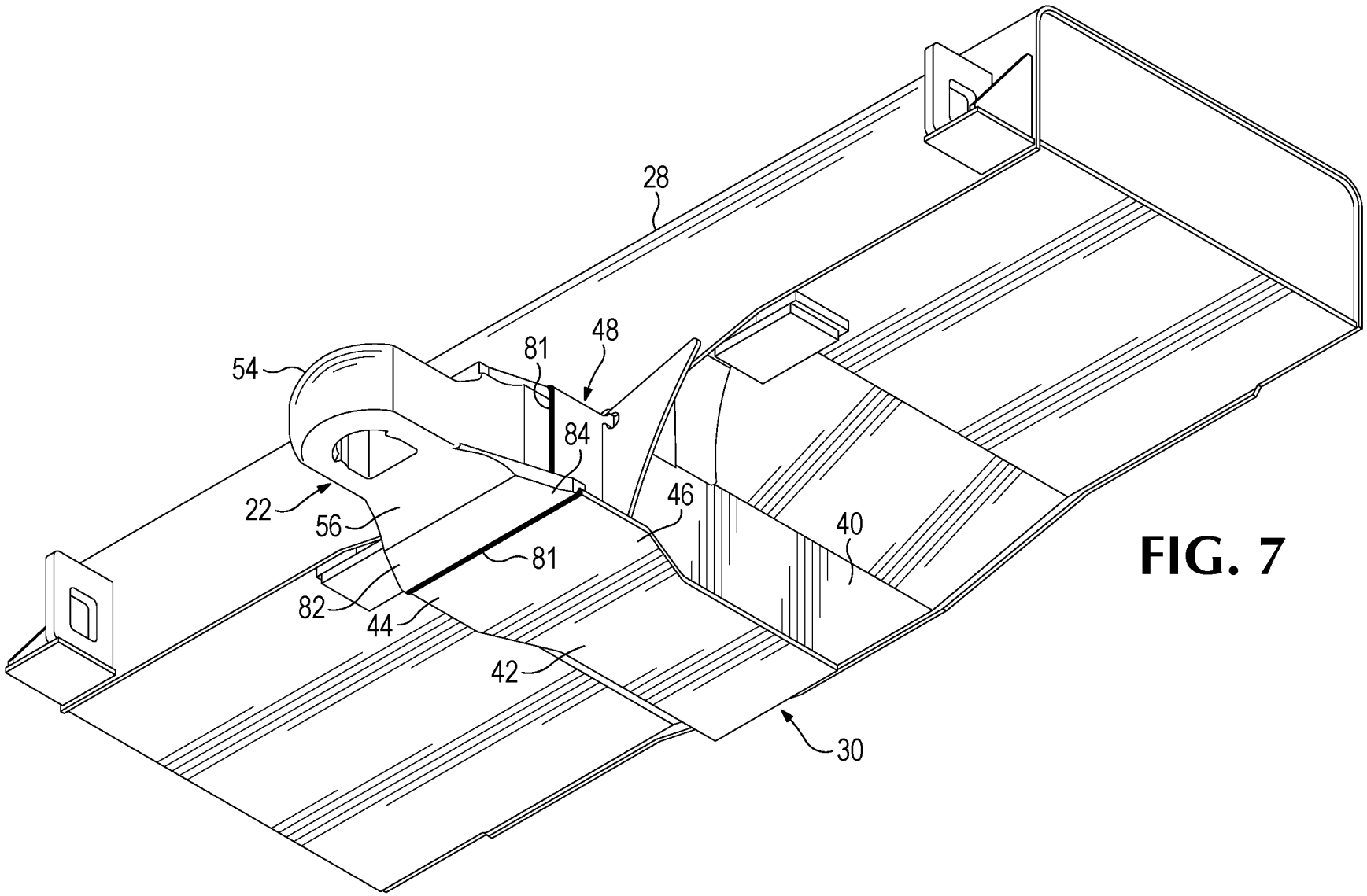
FIG. 7 is an isometric view of the body bolster, the center sill, and the articulated connector shown in FIGS. 3-6, taken from below.

The top member 36 may be of plate with a thickness 37 of 11/16 inch, as seen in FIG. 4, while the laterally adjacent portions of the bottom plate of the body bolster 28 may be slightly thinner. A pair of vertical side members 38 and 40 of the stub center sills 30 and 32 also extend longitudinally with respect to the car unit and are parallel with each other. A bottom plate member 42 extends parallel with the top member 36, interconnecting respective bottom margins of the side members 38 and 40. Each stub center sill 30 and 32 thus forms a rectangular tube. The bottom plate member 42 may extend laterally beyond each of the side members 38 and 40 at 44 and 46, as may be seen in FIGS. 3 and 6.

Each of the stub center sills 30 and 32 has a respective outer end portion 48, and the respective ones of the pair of mated articulated connector portions 22 and 24 are attached to the outer end portions 48 of the stub center sills 30 and 32. A female connecting unit 50 is included in a main body portion 52 of the female articulated connector portion 24 attached to the stub center sill 32 of the car unit 14, and a male connecting unit 54 is included in a main body portion 56 of the male articulated connector portion 22 attached to the stub center sill 30 of the car unit 12. The female connecting unit 50 includes a circular base plate 58 intended to fit within and be supported by a corresponding bowl 60 provided atop the center of the shared wheeled truck 26. This relationship thus provides stability of the intermediate car unit 14 about a roll axis, while supporting the weight of the adjacent end 20 of the intermediate car unit 14 and allowing the truck 26 to follow the curves in a track. It is important for each intermediate unit of such a multi-unit railcar to include at least one articulated connector having such a female connecting unit 50 to provide roll axis stability. Apart from the female and male connecting unit portions 50 and 54 the main body portions 52 and 56 of the mated articulated connector portions 22 and 24 may be similar to each other. The female and male connecting units 50 and 54 as shown herein are of one available design, and other suitable designs are also known.

The male connecting unit 54 included in the main body portion 56 of the male articulated connector portion 22 is mated with and supported by the female connecting unit 50 of the female articulated connector portion 24, with an amount of freedom of rotation about all three axes with respect to the female connecting unit 50. The female connecting unit 50 of the articulated connector 24 thus carries the weight of the adjacent end 18 of the car unit 12 and its lading to the shared truck 26, Additionally, the mated articulated connector portions 22 and 24 carry the draft and buff forces developed by a locomotive and by the brakes of a train including the multi-unit car 10 as the train moves along a track. The respective articulated connector positions 22 and 24 must be connected with each car unit 12, 14, and 16, etc., through the center sills 30, 32, etc., of the car units of a multi-unit railcar 10 in such a way as to be reliably capable of carrying such draft and buff forces, as well as being capable of carrying the weight of each car unit and its lading, and other forces such as those resulting from negotiating curves and incidental irregularities in the track on which the multi-unit car 10 is operated.

As may be seen in FIGS. 3-7, the articulated connector portions 22 and 24 both include respective aligning extensions 62 extending from the main body portion 56 or 52 of each and fitting snugly within the outer end portion 48 of the respective stub center sill 30 or 32, as may be seen in FIGS. 3, 4, 4A, and 5. The outer end portion 48 of the stub center sill 30 has an internal height 66 between its top member 36 and its bottom member 42, and has an internal width 68 between its two lateral side members 40 and 42. For example, the internal height 66 may be 11 7/32 inches, and the internal width 68 may be 12 7/8 inches, in a typical stub center sill 30 to which an articulated connector is attached. The aligning extensions 62 have respective widths and heights that correspond closely, so that each aligning extension 62 fits snugly within the respective outer end portion of the stub center sill 30 or 32, preferably in intimate contact with perspective interior surfaces of the outer end portions 48, and with not more than 1/16 inch clearance. The aligning extensions 62 thus establish the position and orientation of each of the articulated connector mated parts 22 and 24 with respect to the stub center sill 30 or 32 to which it is attached.

Each of the articulated connector mated portions 22 and 24 may be attached in the same manner to the respective stub center sill 30 or 32 with which it is associated. The attachment of the articulated connector male mated portion 22 to the stub center sill 30 will be described now in detail, and it will be understood that the attachment of the female articulated connector mated portion 24 to the stub center sill 32 is essentially similar.

The top member 36, side members 38 and 30 and 40, and bottom member 42 of the stub center sill 30 are all typically, but not necessarily, terminated in alignment with each other, and thus may define an outer end plane 70 of the outer end portion 48. All of the center sill bottom and side members 38, 40, and 42 may be constructed of steel plate members of equal thickness, but at least an outer end portion 72 of the top member 36, extending to the outer end plane 70 over a distance 73 of, for example, at least 10 inches, and preferably 15 inches or more, may have a top member thickness 74 of at least 1⅛ inch, when of commonly used steel. The greater thickness 74 of the outer end portion 72 of the top member 36 may be established as shown in FIG. 3, by a doubler plate 76, having a thickness 77 of 7/16 inch, extending along a bottom face of the top member 36, within the stub center sill 30 or 32. With use of high strength steel in the top member 36 and the doubler plate 76 and a higher strength steel in the castings of the articulated coupler 21 a top member thickness 74 of at least ¾ inch in the outer end portion 72 could be satisfactory.

Figure 4A:
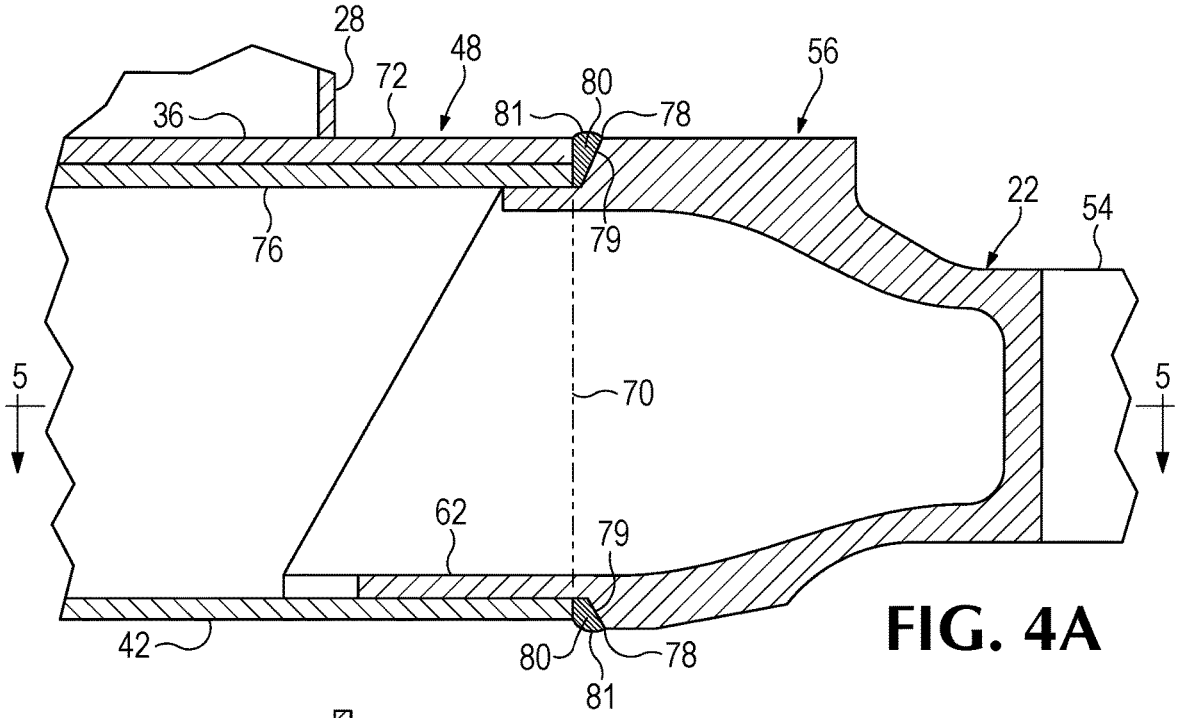
FIG. 4A is a detail view of a portion of FIG. 4, at an enlarged scale.
Figure 5:
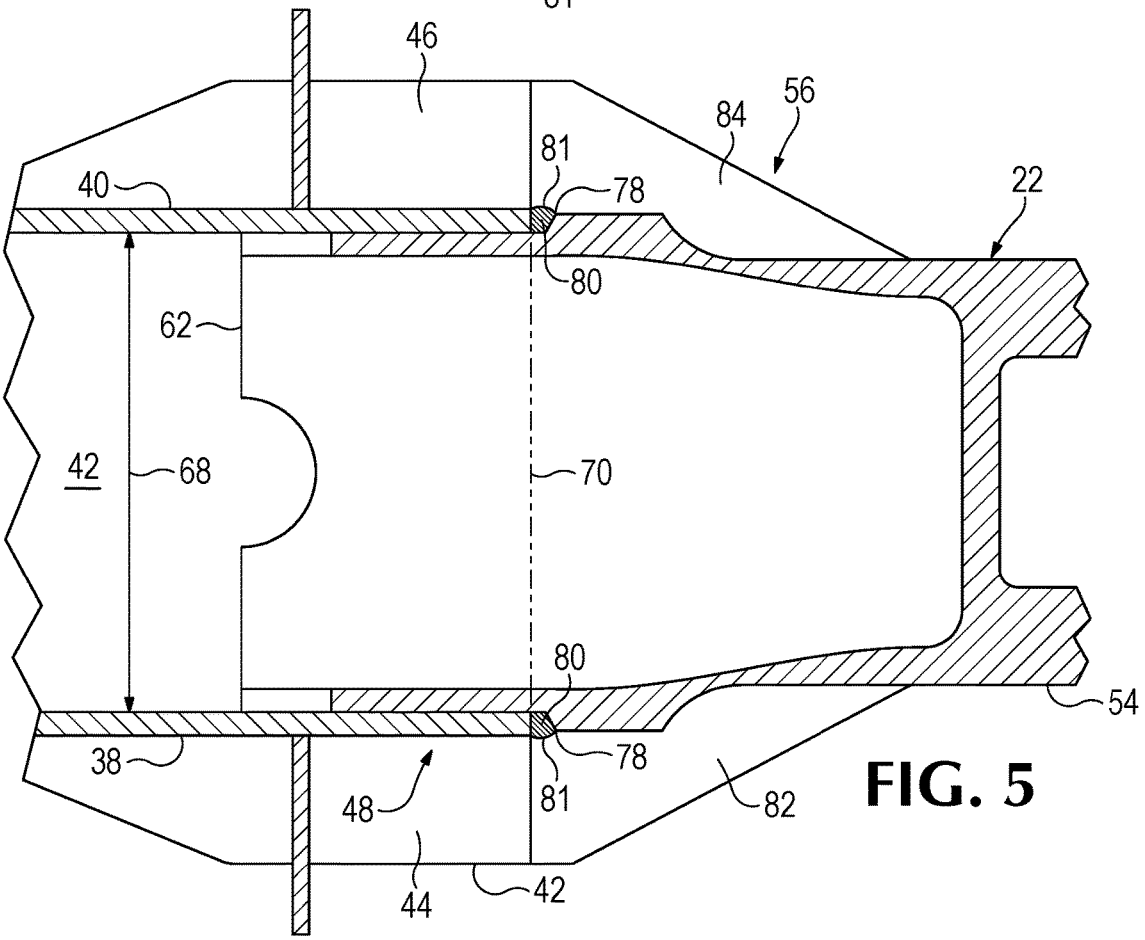
FIG. 5 is a sectional view, taken along line 5-5 in FIG. 4A, showing a portion of the body bolster, center sill, and articulated connector.

The main body portion 56 or 52 of each of the articulated connector portions 22 and 24 ends at a shoulder 78 located adjacent to and facing toward the outer end plane 70 of the respective stub center sill 30 or 32 to which it is attached. Referring now specifically to the attachment of the articulated connector 22 to the stub center sill 30, as best shown in FIGS. 4, 4A, and 5, the shoulder 78 protrudes outwardly with respect to the aligning extension 62 in transverse and vertical directions. The main body portion 56 thus has a greater height and width than the associated aligning extension 62. The shoulder 78 thus is aligned with and closely adjacent to and faces toward end margins of the top member 36, the side members 38 and 40, and the bottom member 42, that may coincide as the outer end plane 70, at the outer end of the stub center sill 30.

As shown in FIGS. 4, 4A, and 5, the outer end plane 70 extends vertically and transversely with respect to the car unit, although it could, if desired, be oriented differently. The shoulder 78 thus extends along the top, bottom, and the two lateral sides of the main body portion 56 of the articulated connector, parallel with the outer end plane 70. An attachment surface 79 of the shoulder 78 faces toward the outer end plane 70 of the stub center sill 30 and may be sloped or inclined outwardly and away from the aligning extension 62. The attachment surface 79, together with the confronting end margin surfaces of the top member 36, the side members 38 and 40, and the bottom member 42, thus forms a generally V-shaped channel 80. The channel 80 extends around the articulated connector 21, and the inner or bottom part of the channel 80 may be closed by a narrow exposed portion of the aligning extension 62 extending away from the main body portion 56, so that the channel 80 provides room for a groove weld 81.

As seen in FIGS. 4A and 5, the groove weld 81 fills the channel 80 defined between the attachment surface 79 of the shoulder 78 and the end margin surfaces of the top member 36, the bottom member 42, and lateral side members 38 and 40 of the outer end portion 48 of the center sill 30 that define the outer end plane 70. The groove weld 81 extends inwardly, to the aligning extension portion 6, on all four sides of the male articulated connector portion 22. The groove weld 81 preferably includes the entire thickness of the bottom member 42 and side members 38 and 40 of the outer end portion 48 of the center sill 30. Additionally, the horizontal lateral extensions 44 and 46 at the bottom of the center sill are welded to corresponding wing-like lateral extensions 82 and 84 of the articulated connector portion 22.

As a result of the top member thickness 74 of the outer end part 72 of the top member 36 of the stub center sill 30 at the outer end plane 70, the portion of the groove weld 81 connecting the outer end portion 72 of the top member 36 of the center sill 30 with the main body portion 56 of the articulated connector portion 22 includes a substantial volume and mass of welded metal. With portions of the groove weld 81 also connecting the shoulder 78 of the male articulated connector portion 22 to the side members 38 and 40 and the bottom member 42 of the outer end portion 48 of the stub center sill 30, the male articulated connector portion 22 is attached to the stub center sill 30 with ample strength to sustain the loads the articulated connector 22 can reasonably be expected to incur.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. In combination, a center sill of a railroad freight car and an attached articulated connector, comprising:

a center sill having an outer end portion including a tube having top and bottom members interconnected by a pair of apart-spaced side members; and an articulated connector attached to the outer end portion, the articulated connector including a main body portion extending away from the center sill and an aligning extension extending a distance within the tube included in the outer end portion of the center sill;

wherein an internal height is defined between the top and bottom members of the tube included in the outer end portion of the center sill and an internal width is defined between the side members of the tube included in the outer end portion, and wherein the top member, bottom member, and side members of the tube have respective end margins cooperatively terminating the tube;

wherein each of the side members and the bottom member of the tube has a respective thickness and wherein an outer end portion of the top member defining the end margin thereof extends over a predetermined distance from the end margin and has a top member thickness that is greater than the thickness of the bottom of member and greater than the thickness of either of the side members of the tube;

wherein the articulated connector includes a shoulder located at an end of the main body portion, adjacent the respective end margins of the top member, the bottom member, and the side members of the tube, the shoulder extending laterally and vertically outward with respect to the aligning extension, and the shoulder therefore having a width greater than the internal width of the outer end portion of the center sill and a height greater than the internal height of the outer end portion of the center sill;

wherein the aligning extension is located within the tube included in the outer end portion of the center sill; and wherein the articulated connector s interconnected with the outer end portion of the center sill by a weld interconnecting respective portions of the shoulder of the articulated connector with the end margins of all of the top member, the bottom member, and the side members of the tube included in the outer end portion of the center sill.

2. The combination of claim 1 wherein the end margins of the top member, the bottom member, and the side members of the tube included in the center sill define an outer end plane.

3. The combination of claim 2 wherein the shoulder of the articulated connector includes an attachment surface sloped outwardly and away from the outer end plane of the center sill, defining a channel between the attachment surface and a surface defining the outer end plane, and wherein the weld is a groove weld including a portion connecting the entire top member thickness of the top member with the adjacent portion of the shoulder.

4. The combination of claim 2 wherein the top member thickness is at least ¾ inch and the portion of the top member defining the outer end plane extends with that top member thickness for a distance of at least 10 inches from the outer end plane.

5. The combination of claim 1 wherein the aligning extension extends along and is in contact with respective interior surfaces of all of the top member, the bottom member, and the side members of the outer end portion of the center sill.

6. A car unit of a multi-unit railroad freight car, comprising:

a car body including a center sill at an end thereof;

a center sill having an outer end portion including a tube having top and bottom members interconnected by a pair of apart-spaced side members; and an articulated connector attached to the outer end portion, the articulated connector including a main body portion extending away from the center sill and an aligning extension extending a distance within the tube included in the outer end portion of the center sill;

wherein an internal height is defined between the top and bottom members of the tube included in the outer end portion of the center sill and an internal width is defined between the side members of the tube included in the outer end portion, and wherein the top member, bottom member, and side members of the tube have respective end margins cooperatively terminating the tube;

wherein each of the side members and the bottom member of the tube has a respective thickness and wherein an outer end portion of the top member defining the end margin thereof extends over a predetermined distance from the end margin and has a top member thickness that is greater than the thickness of the bottom member and greater than the thickness of either of the side members of the tube;

wherein the articulated connector includes a shoulder located at an end of the main body portion, adjacent the respective end margins of the top member, the bottom member, and the side members of the tube, the shoulder extending laterally and vertically outward with respect to the aligning extension, and the shoulder therefore having a width greater than the internal width of the outer end portion of the center sill and a height greater than the internal height of the outer end portion of the center sill;

wherein the aligning extension is located within the tube included in the outer end portion of the center sill; and wherein the articulated connector is interconnected with the outer end portion of the center sill by a weld interconnecting respective portions of the shoulder of the articulated connector with the end margins of all of the top member, the bottom member, and the side members of the tube included in the outer end portion of the center sill.

7. The combination of claim 6 wherein the end margins of the top member, the bottom member, and the side members of the tube included in the center sill define an outer end plane.

8. The combination of claim 7 wherein the shoulder of the articulated connector includes an attachment surface sloped outwardly and away from the outer end plane of the center sill, defining a channel between the attachment surface and a surface defining the outer end plane, and wherein the weld is a groove weld including a portion connecting the entire top member thickness of the top member with the adjacent portion of the shoulder.

9. The combination of claim 7 wherein the top member thickness is at least ¾ inch and the portion of the top member defining the outer end plane extends with that top member thickness for a distance of at least 10 inches from the outer end plane.

10. The combination of claim 6 wherein the aligning extension extends along and is in contact with respective interior surfaces of all of the top member, the bottom member, and the side members of the tube included in the outer end portion of the center sill.

11. A railroad freight car, comprising:

a plurality of car units;

a plurality of wheeled trucks;

each car unit having a body and each body having a pair of opposite ends, a respective end of each of a pair of adjacent ones of the car units being supported by a shared one of the wheeled trucks and the pair of adjacent ones of the car units being interconnected with each other by an articulated connector;

wherein the articulated connector includes a female articulated connector portion attached to one of the pair of adjacent car units and a male articulated connector portion attached to the other one of the pair of adjacent car units;

wherein the body of each one of the pair of adjacent ones of the car units includes a respective center sill having an outer end portion including a tube having top and bottom members interconnected by a pair of apart-spaced side members; and wherein a respective one of the male and female portions of the articulated connector is attached to the outer end portion of the respective center sill of each of the car units, the respective one of the male and female portions including a main body portion extending away from the center sill and an aligning extension extending a distance within the tube included in the outer end portion of the respective center sill;

wherein an internal height is defined between the top and bottom members of the tube included in the outer end portion of each center sill and an internal width is defined between the side members of the tube included in the respective outer end portion and wherein the top member, bottom member, and side members of the respective tube have respective end margins cooperatively terminating the respective tube;

wherein each of the side members and the bottom member of each tube has a respective thickness and wherein an outer end portion of the top member defining the end margin thereof extends over a predetermined distance from the end margin and has a top member thickness that is greater than a thickness of the bottom member and greater than the thickness of either of the side members of the respective tube;

wherein the respective one of the male and female portions of the articulated connector includes a shoulder located at an end of the respective main body portion, adjacent the respective end margins of the top member, the bottom member, and the side members of the respective tube, the shoulder extending laterally and vertically outward with respect to the aligning extension, and the shoulder therefore having a width greater than the internal width of the respective tube and a height greater than the internal height of the respective tube;

wherein the respective aligning extension is located within the tube included in the outer end portion of the respective center sill; and wherein the respective one of the male and female portions of the articulated connector is interconnected with the outer end portion of the respective center sill by a weld interconnecting respective portions of the shoulder of the articulated connector with each of the top member, the bottom member, and each of the side members of the tube included in the outer end portion of the respective center sill.

12. The combination of claim 11 wherein the end margins of the top member, the bottom member, and the side members of the tube included in the outer end portion of a respective center sill define an outer end plane.

13. The combination of claim 12 wherein the shoulder of the respective one of the male and female portions of the articulated connector includes an attachment surface sloped outwardly and away from the outer end plane of the center sill, and wherein the weld is a groove weld including a portion connecting the entire top member thickness of the top member with the adjacent portion of the attachment surface of the shoulder.

14. The combination of claim 12 wherein the top member thickness of one of the tubes included in the center sills is at least ¾ inch and the portion of the top member defining the outer end plane extends with that top member thickness for a distance of at least 10 inches from the outer end plane.

15. The combination of claim 11 wherein the aligning extension of a respective one of the male and female portions extends along and is in contact with respective interior surfaces of all of the top member, the bottom member, and the side members of the tube included in the outer end portion of the respective center sill.

* * * * *